US010612494B2

(12) United States Patent
Xue et al.

(10) Patent No.: US 10,612,494 B2
(45) Date of Patent: Apr. 7, 2020

(54) FUEL ENRICHMENT SIMPLE STARTING DEVICE, STARTING SYSTEM AND METHOD THEREOF

(71) Applicant: Meiying Xue, Hangzhou (CN)

(72) Inventors: Meiying Xue, Hangzhou (CN); Yongcheng Jia, Hangzhou (CN)

(73) Assignee: Meiying Xue, Hangzhou (CN)

( * ) Notice: Subject to any disclaimer, the term of this patent is extended or adjusted under 35 U.S.C. 154(b) by 0 days.

(21) Appl. No.: 16/407,181

(22) Filed: May 9, 2019

(65) Prior Publication Data

US 2019/0264638 A1 Aug. 29, 2019

Related U.S. Application Data

(63) Continuation-in-part of application No. 15/417,040, filed on Jan. 26, 2017, now Pat. No. 10,330,048.

(30) Foreign Application Priority Data

Oct. 30, 2016 (CN) ..... 2016 1 0925134
Apr. 25, 2019 (CN) ..... 2019 1 0340481
Apr. 25, 2019 (CN) ..... 2019 2 0581914 U

(51) Int. Cl.

| | |
|---|---|
| ***F02M 1/02*** | (2006.01) |
| ***F02M 1/16*** | (2006.01) |
| ***F02M 17/04*** | (2006.01) |
| *F02N 3/02* | (2006.01) |
| *F02B 63/00* | (2006.01) |

(52) U.S. Cl.
CPC ..... *F02M 1/02* (2013.01); *F02M 1/16* (2013.01); *F02M 17/04* (2013.01); *F02B 63/00* (2013.01); *F02N 3/02* (2013.01)

(58) Field of Classification Search
CPC . F02M 1/02; F02M 17/04; F02M 1/16; F02B 63/00; F02N 3/02
See application file for complete search history.

(56) References Cited

U.S. PATENT DOCUMENTS

2002/0135082 A1* 9/2002 Woody ..... F02M 1/16 261/35
2008/0135018 A1* 6/2008 Keeton ..... F02D 41/062 123/437
2012/0318249 A1* 12/2012 Warfel ..... F02M 1/02 123/704

* cited by examiner

*Primary Examiner* — Xiao En Mo

(57) ABSTRACT

A fuel enrichment simple starting device for a carburetor includes a fuel cup and a main body, which includes a mixing room, a metering room, a fuel chamber separated into a fuel pumping chamber and a fuel enrichment chamber, a fuel inputting passage, a fuel passage, a starting passage and a fuel returning passage. The fuel pumping chamber and the fuel enrichment chamber are in communication with the fuel cup. One end of the fuel inputting passage is in communication with the fuel enrichment chamber, and the other end thereof is in communication with the metering room. One end of the starting passage is in communication with the fuel enrichment chamber, and the other end thereof is in communication with the mixing room. One end of the fuel returning passage is in communication with the fuel cup, and the other end thereof is in communication with a fuel tank.

12 Claims, 19 Drawing Sheets

FUEL ENRICHMENT SIMPLE STARTING DEVICE, STARTING SYSTEM AND METHOD THEREOF

CROSS-REFERENCE TO RELATED APPLICATIONS

This application claims all benefits accruing under 35 U.S.C. § 119 from China Patent Application Nos. 201920581914.X, filed on Apr. 25, 2019, and 201910340481.3, filed on Apr. 25, 2019, in the State Intellectual Property Office of China, the content of which is hereby incorporated by reference. This application is also a continuation-in-part of U.S. patent application Ser. No. 15/417,040 filed on Jan. 26, 2017, which claims all benefits accruing under 35 U.S.C. § 119 from China Patent Application No. 201610925134.3, filed on Oct. 30, 2016, and the content of which is also hereby incorporated by reference.

TECHNICAL FIELD

The present disclosure relates to the field of carburetor, in particular to a fuel enrichment simple starting device of carburetor, an engine starting system and method thereof.

BACKGROUND

When an engine is in a warm state, a ratio of air and fuel in the economy is in a range of 13:1-15:1 set by the factory. But when the engine starts in a cold state, the ratio of air and fuel needs to be in a higher range of 6:1-12:1 because the carburetor needs to provide additional fuel to the engine to ensure that the engine can start normally.

At present, a choke device is widely used to reduce the amount of air to achieve a high air-fuel ratio. An engine starting method usually includes the following steps: step (1), squeezing the purge bulb; step (2), closing the choke; step (3), opening the throttle fully or setting the throttle in the fast idle speed position; step (4), pulling an engine starter until a POP sound is generated; step (5), pulling the choke to a one-half open position; step (6), pulling the engine starter to start the engine; step (7), keeping the engine running warm; step (8), pulling the choke to a full open position; and step (9), increasing and decreasing the throttle to normal running. The disadvantages of the present choke device are as follows: firstly, steps are cumbersome; secondly, it is difficult to judge the POP sound, resulting in difficulty starting the engine; and thirdly, the engine is difficult to or cannot start at low temperature (such as 0 degree centigrade).

SUMMARY

An embodiment of the present disclosure includes a fuel enrichment simple starting device for a carburetor including a main body and a fuel cup disposed on the main body. The main body includes a mixing room, a metering room and a fuel chamber. The main body further includes a fuel pump diaphragm located in the fuel chamber and configured for separating the fuel chamber into a fuel pumping chamber and a fuel enrichment chamber. The main body further includes a fuel inputting passage, a fuel passage, a starting passage and a fuel returning passage.

The fuel pumping chamber is in communication with the fuel cup, and the fuel enrichment chamber is in communication with the fuel cup through the fuel passage. One end of the fuel inputting passage is in communication with the fuel enrichment chamber, and the other end of the fuel inputting passage is in communication with the metering room. One end of the starting passage is in communication with the fuel enrichment chamber, and the other end of the starting passage is in communication with the mixing room. One end of the fuel returning passage is in communication with the fuel cup, and the other end of the fuel returning passage is in communication with a fuel tank.

Furthermore, a first retaining valve is located in the fuel inputting passage and configured to prevent fuel in the fuel enrichment chamber from returning to the metering room.

Furthermore, a second retaining valve is located in the starting passage and configured to prevent fuel and air in the mixing room from returning to the fuel enrichment chamber.

Furthermore, a duckbill valve is disposed in the fuel returning passage, the fuel passage and the fuel returning passage are separated by the duckbill valve, and fuel in the fuel cup returns to the fuel tank through the duckbill valve and the fuel returning passage.

Furthermore, the main body further includes a pump transferring passage, one end of the pump transferring passage is in communication with the fuel cup, and the other end of the pump transferring passage is in communication with the fuel pumping chamber. A positive pressure generated by pressing the fuel cup is transmitted to the fuel pumping chamber through the pump transferring passage to drive the fuel pump diaphragm to vibrate.

Furthermore, the main body further includes a pressure balancing passage. One end of the pressure balancing passage is in communication with the starting passage, and the other end of the pressure balancing passage is in communication with the atmosphere.

Furthermore, the main body further includes a choke configured for controlling a ratio of air entering the mixing room.

A starting system of an engine including an engine and the fuel enrichment simple starting device of carburetor is provided. The fuel enrichment simple starting device of carburetor is connected with the engine.

A starting method of an engine including the fuel enrichment simple starting device for a carburetor includes: pressing the fuel cup, generating and transmitting a positive pressure to the fuel pumping chamber, and driving the fuel pump diaphragm to vibrate, resulting in injection of part of the fuel in the fuel enrichment chamber into the mixing room through the starting passage; and pulling an engine starter until the engine starts.

Furthermore, the step of the pressing the fuel cup further includes: pressing the fuel cup and at the same time, part of the fuel in the fuel cup returns to the fuel tank through the fuel returning passage; releasing the fuel cup, generating a negative pressure, sucking fuel in the metering room into the fuel enrichment chamber through the fuel inputting passage, and at the same time, sucking part of the fuel in the fuel enrichment chamber into the fuel cup through the fuel passage.

Furthermore, a first retaining valve is disposed in the fuel inputting passage, a second retaining valve is disposed in the starting passage, in the step of pressing the fuel cup, the first retaining valve is closed and the second retaining valve is opened.

Furthermore, in the step of releasing the fuel cup, the first retaining valve is opened and the second retaining valve is closed.

Furthermore, the starting method of the engine includes closing the choke after pressing the fuel cup and before the step of pulling the engine starter.

The fuel enrichment simple starting device for a carburetor according to the present disclosure has many advantages. The fuel enrichment simple starting device for a carburetor includes the fuel cup, the fuel inputting passage, the fuel passage, the starting passage and the fuel returning passage. When pressing the fuel cup, a positive pressure is generated and transmitted to the fuel pumping chamber, and the fuel pump diaphragm is driven to move, resulting in the injection of part of the fuel in the fuel enrichment chamber into the mixing room through the starting passage for starting the engine. At the same time, part of the fuel in the fuel cup returns to the fuel tank through the fuel returning passage. When releasing the fuel cup, a negative pressure is generated, fuel in the metering room is sucked into the fuel enrichment chamber through the fuel inputting passage, and at the same time, part of the fuel in the fuel enrichment chamber is sucked into the fuel cup through the fuel passage. It can be concluded that, the metering room, the fuel inputting passage, the fuel enrichment chamber, the fuel passage, the fuel cup, and the fuel returning passage can form an air and fuel clearing passage to remove excess air in the main body. The metering room, the fuel inputting passage, the fuel enrichment chamber, the starting passage, and the mixing room can form a fuel injecting passage. When pressing the fuel cup, the excess air in the main body will be removed, and at the same time, the part of fuel in the fuel enrichment chamber can be injected into the mixing room. As a result, the ratio of air and fuel can be increased, making the engine easier and more convenient to start. The fuel enrichment simple starting device for a carburetor is not only simple, but also easier to operate and start at a low temperature, resulting in a reduction of attempts to start the engine and obtaining higher efficiency.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
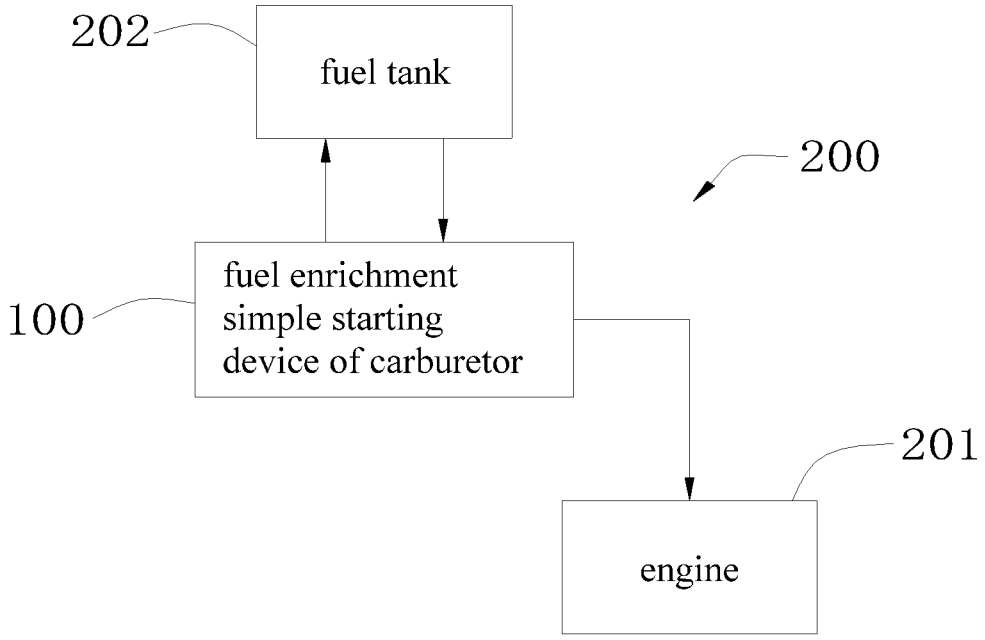
FIG. 1 is a block diagram of an engine starting system of the present disclosure.

Referring to FIG. 1, an embodiment of the present disclosure includes a starting system 200 of an engine mainly applied to outdoor garden tools, such as mowers, fellers, and so on. Since the outdoor garden tools are small in size and hand-held, most of them can be started by hand. Of course, in other embodiments, the engine starting system 200 can also be applied to other devices or machines that are not hand-held.

The starting system 200 of the engine includes an engine 201 and a fuel enrichment simple starting device for a carburetor 100 connected with the engine 201. The fuel enrichment simple starting device 100 is configured for providing fuel for the engine 201 before the engine 201 starts, resulting in reducing the number of engine starts and obtaining higher efficiency. In one embodiment, the engine 201 is easier to start at a low temperature, such as in a range of −15 degree centigrade to 5 degree centigrade.

The fuel enrichment simple starting device 100 can be applied in both a rotary valve type carburetor and a butterfly valve carburetor. Of course, the working principles of the fuel enrichment simple starting device 100 in either the rotary valve type carburetor or the butterfly valve carburetor are basically the same, with the difference being the location of the oil path. In the present disclosure, a butterfly valve carburetor is provided, and structure and working principle of the fuel enrichment simple starting device 100 are illustrated.

Referring to FIGS. 1 to 12, the fuel enrichment simple starting device 100 includes a main body 10 and a fuel cup 20 disposed on the main body 10. The main body 10 further includes a fuel pump diaphragm 11 located in the main body 20. The main body 20 includes a mixing room 12, a metering room 13 and a fuel chamber 14. The fuel pump diaphragm 11 is configured for separating the fuel chamber 14 into a fuel pumping chamber 14*a* and a fuel enrichment chamber 14*b*. The mixing room 12 is in communication with an intake manifold of the engine 201, in order to enable fuel in the mixing room 12 to enter the intake manifold for starting the engine 201. The metering room 13 is configured to measure the amount of fuel and in communication with a fuel tank 202 through an oil passage.

The fuel pump diaphragm 11 can be made of plastic, rubber or other material. The fuel pump diaphragm 11 can be a flat plate and can vibrate back and forth when the fuel cup 20 is pressed and released. The fuel cup 20 is able to deform when it is pressed. The fuel cup 20 can be made of flexible plastic, rubber and so on.

Of course, besides the main body 10 and the fuel cup 20, the fuel enrichment simple starting device 100 further includes a throttle assembly, a choke assembly, and a linkage assembly, which cooperate to achieve overall function of the fuel enrichment simple starting device 100. It can be understood that, in this embodiment, the throttle assembly, the choke assembly, and the linkage assembly are understood in the art and so are not described herein.

Figure 11:
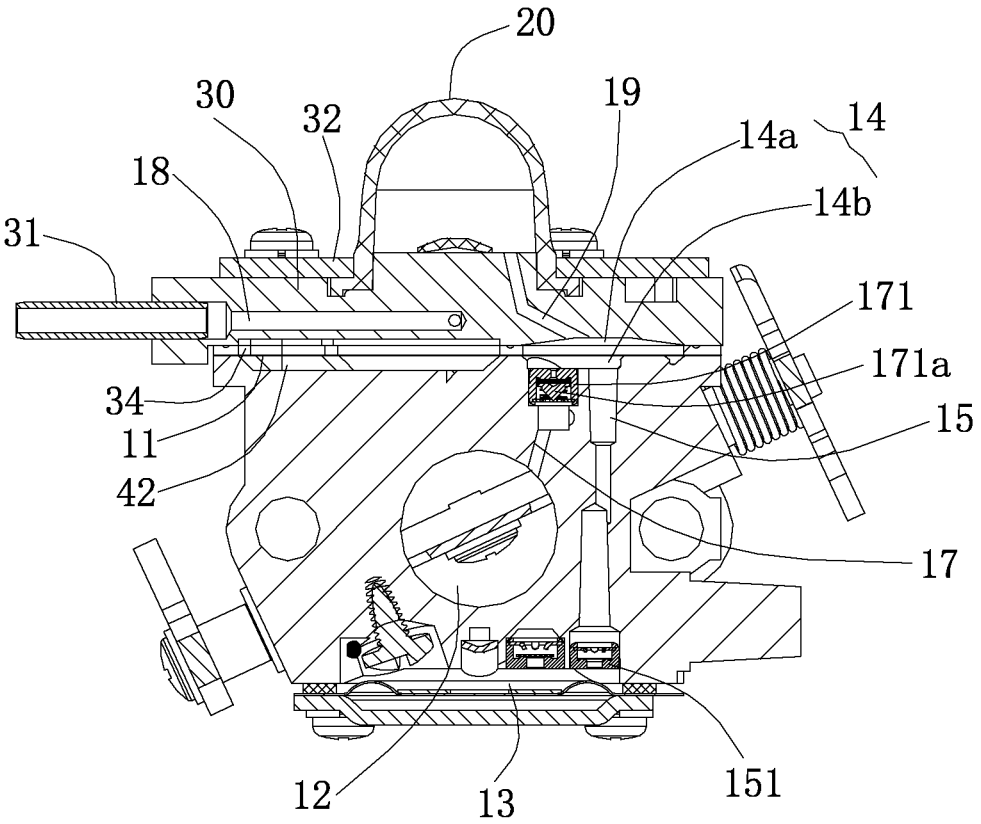
FIG. 11 is a cutaway view of the fuel enrichment simple starting device in FIG. 5 along line XI-XI.
Figure 12:
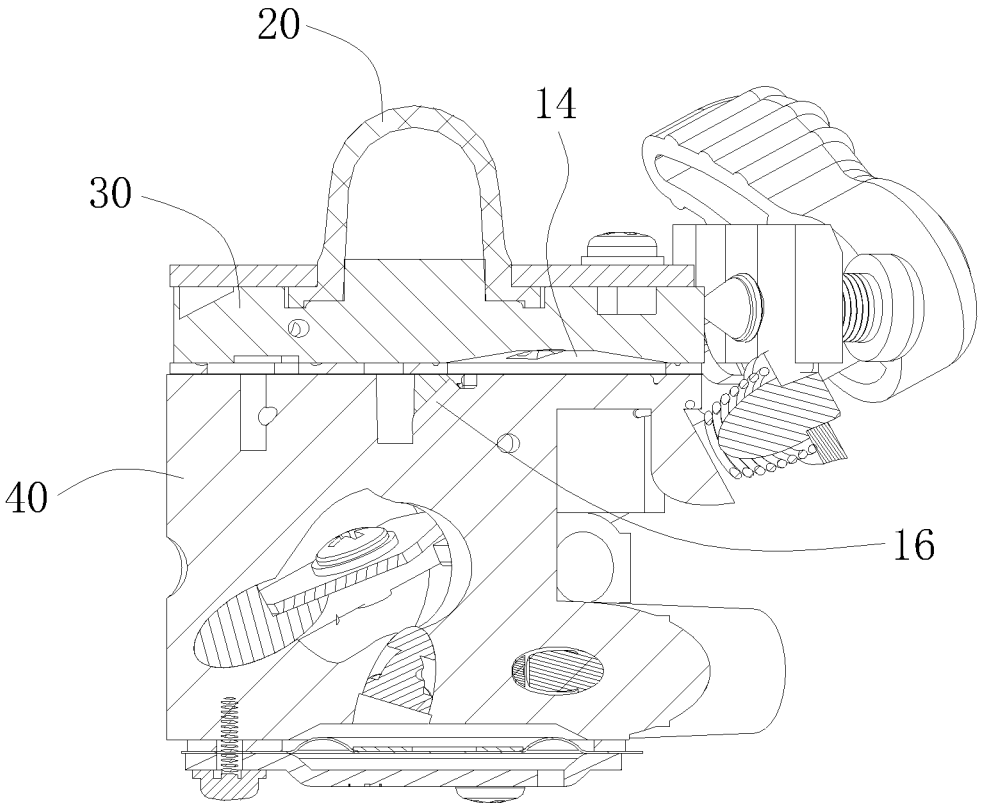
FIG. 12 is a cutaway view of the fuel enrichment simple starting device in FIG. 6 along line XII-XII.
Figure 16:
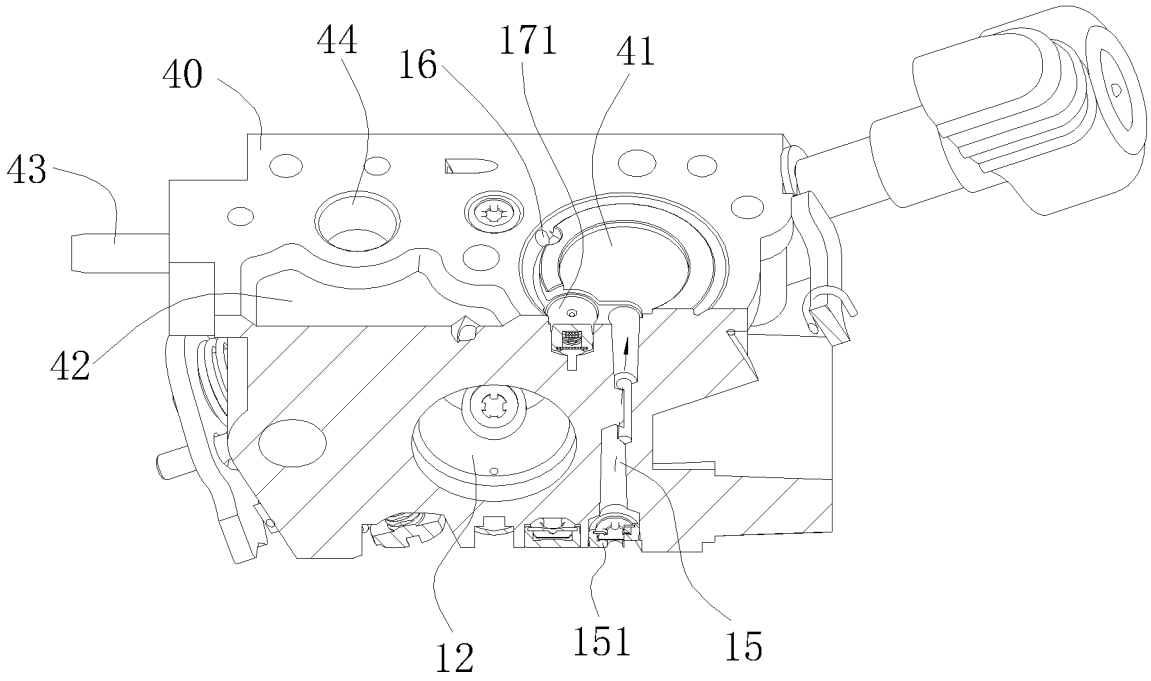
FIG. 16 is a cutaway view of part of a main body of the fuel enrichment simple starting device in FIG. 6.
Figure 17:
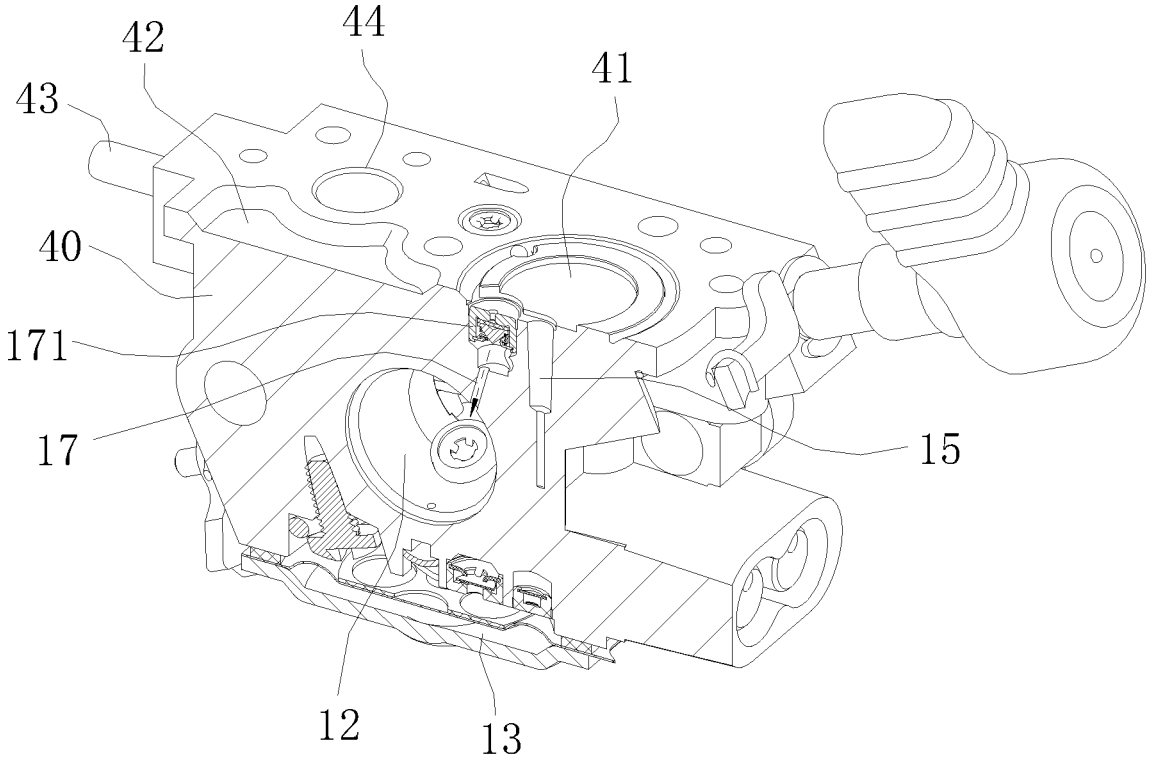
FIG. 17 is another cutaway view of part of the main body of the fuel enrichment simple starting device in FIG. 6.
Figure 18:
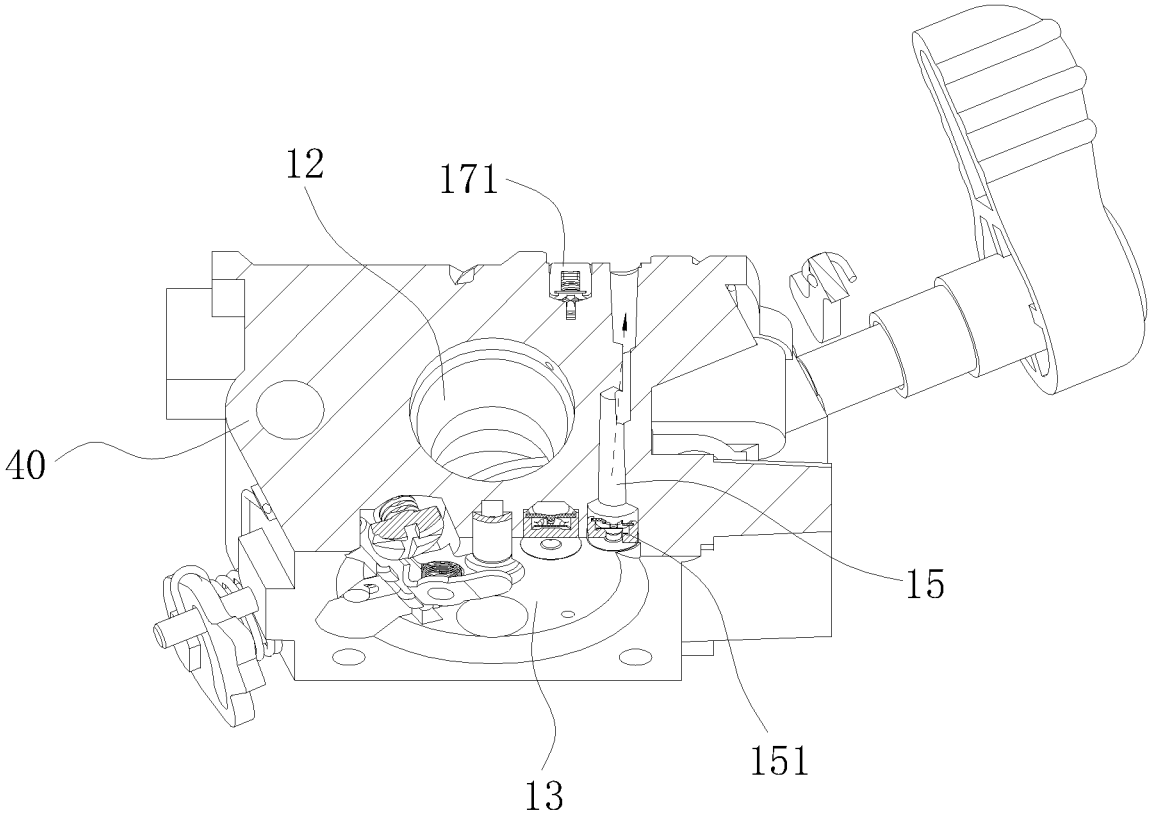
FIG. 18 is another cutaway view of part of the main body of the fuel enrichment simple starting device in FIG. 6.

Referring to FIGS. 13 to 18, the main body 10 further includes a fuel inputting passage 15, a fuel passage 16, a starting passage 17 and a fuel returning passage 18. The fuel pumping chamber 14*a* is in communication with the fuel cup 20. The fuel enrichment chamber 14*b* is in communication with the fuel cup 20 through the fuel passage 16 (as shown in FIGS. 11 and 12). One end of the fuel inputting passage 15 is in communication with the fuel enrichment chamber 14*b*, and the other end of the fuel inputting passage 15 is in communication with the metering room 13 (as shown in FIGS. 11 and 18). One end of the starting passage 17 is in communication with the fuel enrichment chamber 14*b*, and the other end of the starting passage 17 is in communication with the mixing room 12 (as shown in FIGS. 11 and 17). One end of the fuel returning passage 18 is in communication with the fuel cup 20, and the other end of the fuel returning passage 18 is in communication with the fuel tank 202 (as shown in FIGS. 1, 11 and 17).

When pressing the fuel cup 20, a positive pressure can be generated and transmitted to the fuel pumping chamber 14*a*. Under the positive pressure, the fuel pump diaphragm 11 can be driven to vibrate, resulting in part of fuel in the fuel enrichment chamber 14*b* injecting into the mixing room 12 through the starting passage 17 and the engine 201 starts. Part of the fuel in the fuel cup 20 can return to the fuel tank 202 through the fuel returning passage 18.

When releasing the fuel cup 20, a negative pressure can be generated. Fuel in the fuel tank 202 can be sucked into the metering room 13. Fuel in the metering room 13 can be sucked into the fuel enrichment chamber 14*b* through the fuel inputting passage 15. And at the same time, part of the fuel in the fuel enrichment chamber 14*b* can be sucked into the fuel cup 20 through the fuel passage 16.

It can be concluded that, the metering room 13, the fuel inputting passage 15, the fuel enrichment chamber 14*b*, the fuel passage 16, the fuel cup 20, and the fuel returning passage 18 can form an air and fuel clearing passage to remove excess air in the main body 10. The metering room 13, the fuel inputting passage 15, the fuel enrichment chamber 14*b*, the starting passage 17, and the mixing room 12 can form a fuel injecting passage, which can provide fuel for the engine 201. When pressing the fuel cup 20, the excess air in the main body will be removed, and at the same time, the part of fuel in the fuel enrichment chamber 14*b* can be injected into the mixing room 12. Then the ratio of air and fuel can be increased, resulting in making the engine 201 start easier and more conveniently. The fuel enrichment simple starting device 100 of carburetor is not only simple, but also easier to operate and start at a low temperature, resulting in reducing number of starting times of the engine 201 and obtaining higher efficiency.

Figure 8:
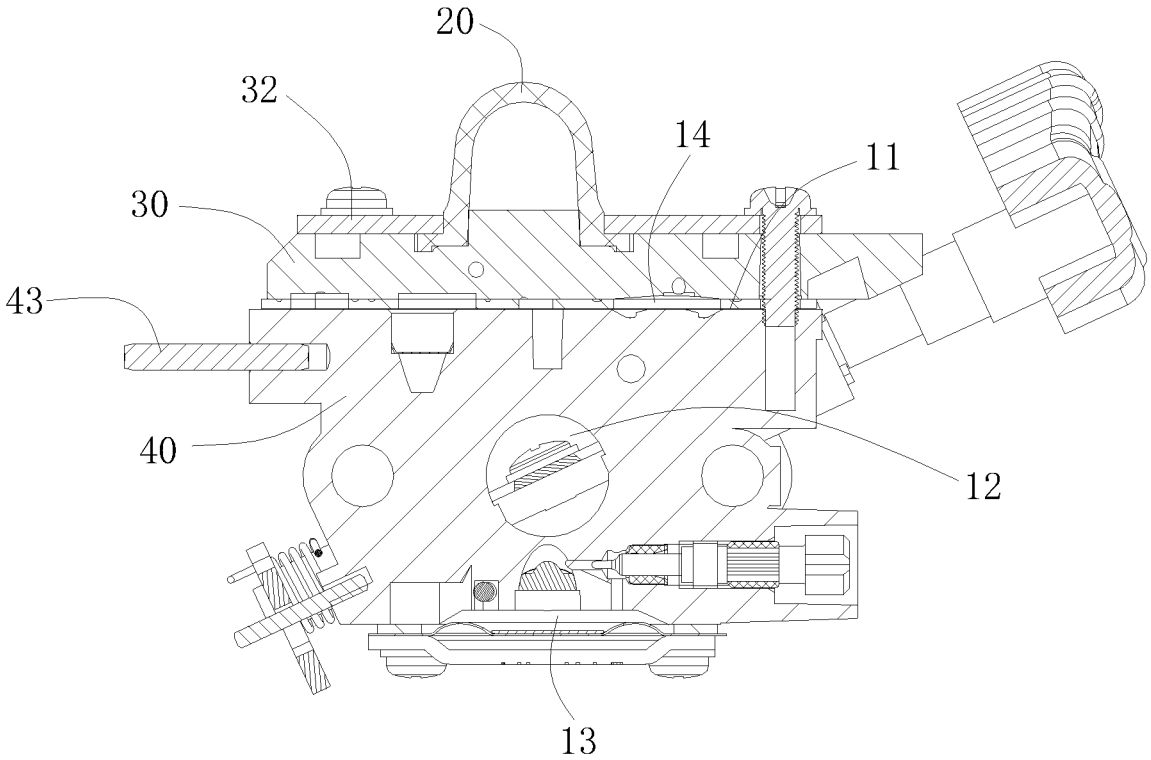
FIG. 8 is a cutaway view of the fuel enrichment simple starting device in FIG. 4 along line VIII-VIII.
Figure 9:
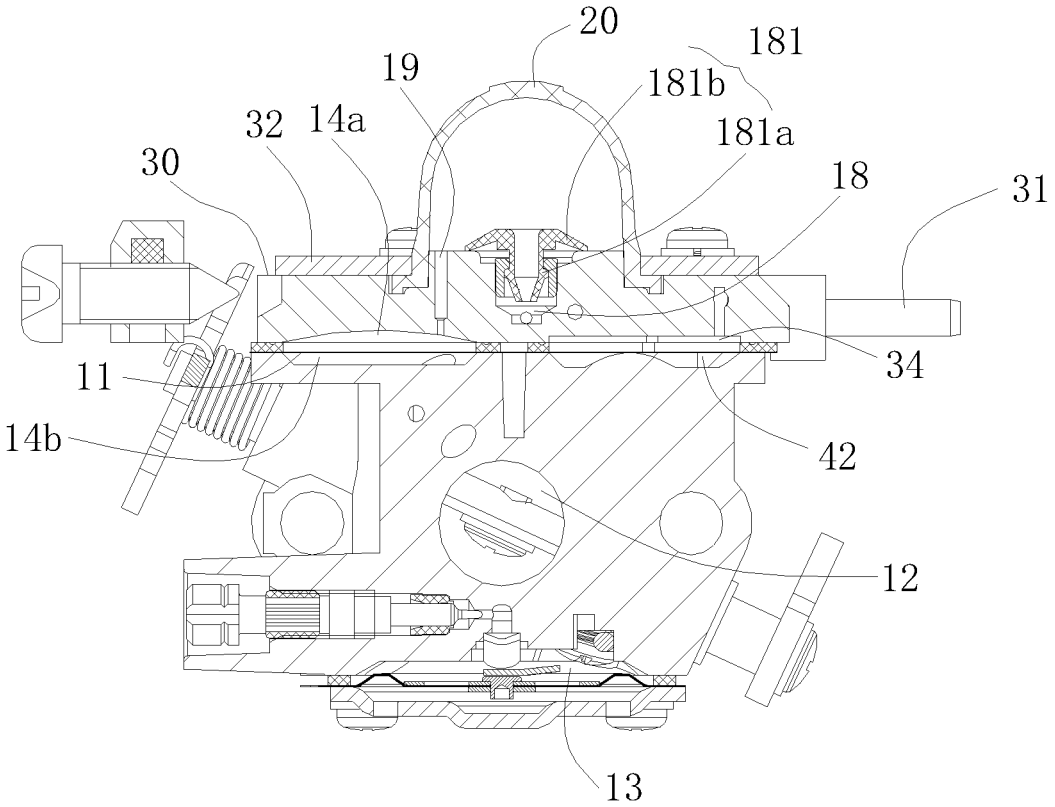
FIG. 9 is a cutaway view of the fuel enrichment simple starting device in FIG. 4 along line IX-IX.
Figure 10:
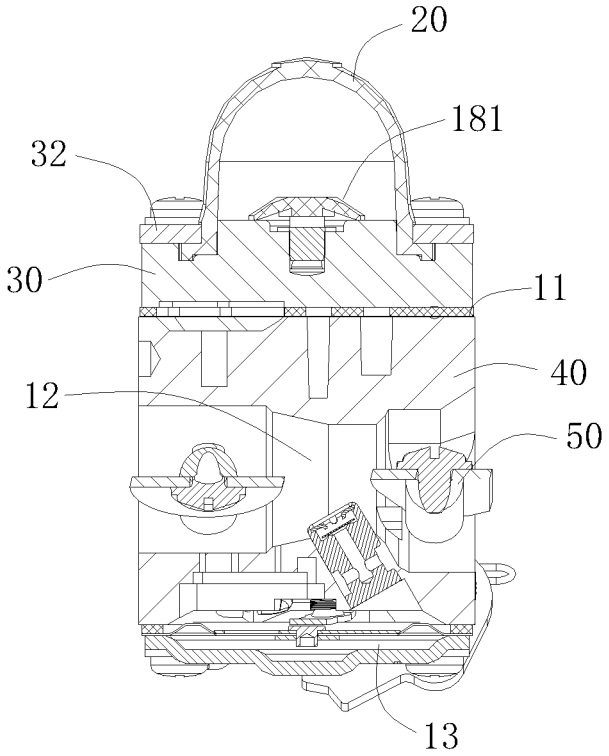
FIG. 10 is a cutaway view of the fuel enrichment simple starting device in FIG. 4 along line X-X.

Referring to FIGS. 8 to 10, the main body 10 further includes a pump transferring passage 19. One end of the pump transferring passage 19 is in communication with the fuel cup 20, and the other end of the pump transferring passage 19 is in communication with the fuel pumping chamber 14*a*. The fuel cup 20, the pump transferring passage 19, the fuel pumping chamber 14*a*, and the fuel pump diaphragm 11 can form a pump. When pressing the fuel cup 20, a pressure can be generated and transmitted to the fuel pumping chamber 14*a* through the pump transferring passage 19 to drive the fuel pump diaphragm 11 to vibrate, resulting in providing fuel for the engine 201.

Referring to FIG. 11, a first retaining valve 151 can be located in the fuel inputting passage 15 and configured to prevent fuel in the fuel enrichment chamber 14*b* from returning to the metering room 13. The first retaining valve 151 allows the fuel to flow one-way. That is, the fuel can flow from the metering room 13 to the fuel enrichment chamber 14*b*, and cannot flow from the fuel enrichment chamber 14*b* to the metering room 13. In other embodiments, other structures rather than the first retaining valve 151 may be employed as long as fuel in the fuel enrichment chamber 14*b* can be prevented from flowing into the metering room 13, and the fuel in the metering room 13 is allowed to enter the fuel enrichment chamber 14*b*.

The first retaining valve 151 can be a check valve with or without a spring. In one embodiment, the first retaining valve 151 is the check valve without the spring. As referring to FIG. 6, a third retaining valve 161 is located in the fuel passage 16 and configured for preventing fuel and air in the fuel cup 20 and the fuel passage 16 from flowing back into the fuel enrichment chamber 14*b*.

Referring to FIGS. 11 and 17, a second retaining valve 171 is located in the starting passage 17. The mounting direction of the second retaining valve 171 is opposite to the mounting direction of the first retaining valve 151. The second retaining valve 171 is configured to prevent the fuel and the air in the mixing room 12 from returning to the fuel enrichment chamber 14*b*. The second retaining valve 171 allows the fuel to flow one-way. That is, the fuel and the air can flow from the fuel enrichment chamber 14*b* to the mixing room 12, and cannot flow from the mixing room 12 to the fuel enrichment chamber 14*b*. In other embodiments, other structures rather than the second retaining valve 171 may be employed as long as fuel in the mixing room 12 can be prevented from flowing into the fuel enrichment chamber 14*b*, and the fuel in the fuel enrichment chamber 14*b* is allowed to enter the mixing room 12.

The second retaining valve 171 can be a check valve with or without a spring. In one embodiment, the second retaining valve 171 is the check valve with the spring.

Referring to FIG. 11, the second retaining valve 171 can include a conical body 171*a*. The conical body 171*a* is mounted on an inner wall of valve body of the second retaining valve 171. A spring is sleeved on the conical body 171*a*, and one end of the spring abuts against the inner wall of the valve body, and the other end of the spring abuts against the conical body 171*a*. A tip end of the conical body 171*a* is disposed toward an outlet of the second retaining valve 171. The spring is configured for guiding the movement of the conical body 171*a* to avoid any offset of position during the movement of the spring.

Referring to FIG. 9, a duckbill valve 181 is disposed in the fuel returning passage 18. The fuel passage 16 and the fuel returning passage 18 are separated by the duckbill valve 181. And fuel in the fuel cup 20 can return to the fuel tank 202 through the duckbill valve 181 and the fuel returning passage 18.

The duckbill valve 181 can include a main valve part 181*a* and an umbrella part 181*b* connected with the main valve part 181*a*. The main valve part 181*a* can be mounted in the fuel returning passage 18 and able to open when pressing the fuel cup 20 and close when releasing the fuel cup 20. The umbrella part 181*b* is disposed at an inlet of the fuel passage 16, and the umbrella part 181*b* seals the fuel passage 16 to separate the fuel returning passage 18 from the fuel passage 16. The umbrella part 181*b* can be elastic and can be deformable.

The duckbill valve 181 can be deformable and made of flexible plastic, rubber or other material.

When pressing the fuel cup 20, under the positive pressure in the fuel cup 20, the main valve part 181*a* is opened, the fuel in the fuel cup 20 can return to the fuel tank 202 through the fuel returning passage 18; at the same time, the inlet of the fuel passage 16 is closed and the fuel passage 16 is sealed. When releasing the fuel cup 20, under the negative pressure formed in the fuel cup 20, the main valve part 181*a* is closed; at the same time, the umbrella part 181*b* is lifted, the inlet of the fuel passage 16 is open and the fuel in the fuel enrichment chamber 14*b* flows into the fuel cup 20 through the fuel passage 16.

It can be understood that, pressing and releasing the fuel cup 20 repeatedly can form a continuous positive and negative pressure, so that the pump oil diaphragm 11 is driven to reciprocate; that is, the pump is formed. The fuel in the metering room 13 can flow to the fuel enrichment chamber 14*b*, and the fuel in the fuel enrichment chamber 14*b* can be further pumped into the starting passage 17 and enter the mixing room 12. The fuel in the fuel enrichment chamber 14*b* can partially enter the fuel cup 20 through the fuel passage 16 and the fuel in the fuel cup 20 can return to the fuel tank 202 through the fuel returning passage 18.

When the fuel cup 20 is pressed, the second retaining valve 171 is opened, and the fuel in the fuel enrichment chamber 14*b* injects into the mixing room 12 through the starting passage 17. At the same time, the first retaining valve 151 in the fuel inputting passage 15 and the third retaining valve 161 in the fuel passage 16 are closed. When releasing the fuel cup 20, the first retaining valve 151 and the third retaining valve 161 are opened, the fuel in the metering room 13 enters into the fuel enrichment chamber 14*b* through the fuel inputting passage 15, and part of the fuel in the fuel enrichment chamber 14*b* enters into the fuel cup 20 through the fuel passage 16. At the same time, the second retaining valve 171 is closed, resulting in the fuel enrichment chamber 14*b* is filled with the fuel which will inject into the mixing room 12 subsequently.

Referring to FIG. 8, the main body 10 includes a cover portion 30 and a base 40. The fuel pump diaphragm 11 is mounted between the cover portion 30 and the base 40. The fuel cup 20 is mounted on the cover portion 30. The fuel returning passage 18 and the pump transferring passage 19 are located in the cover portion 30. The mixing room 12, the metering room 13, the fuel inputting passage 15, and the starting passage 17 located in the base 40.

Referring to FIGS. 10 to 12, the cover portion 30 includes a fuel return pipe 31 and a cover plate 32. One end of the fuel return pipe 31 is in communication with the fuel returning passage 18, and the other end of the fuel return pipe 31 is in communication with the fuel tank 202. The fuel in the fuel cup 20 can flow to the fuel tank 202 through the fuel returning passage 18 and the fuel return pipe 31. So the excess air and fuel can be removed. The cover plate 32 is located on a side of the cover portion 30 where the fuel cup 20 is disposed. The cover plate 32 is configured for position setting of the fuel cup 20.

Figure 13:
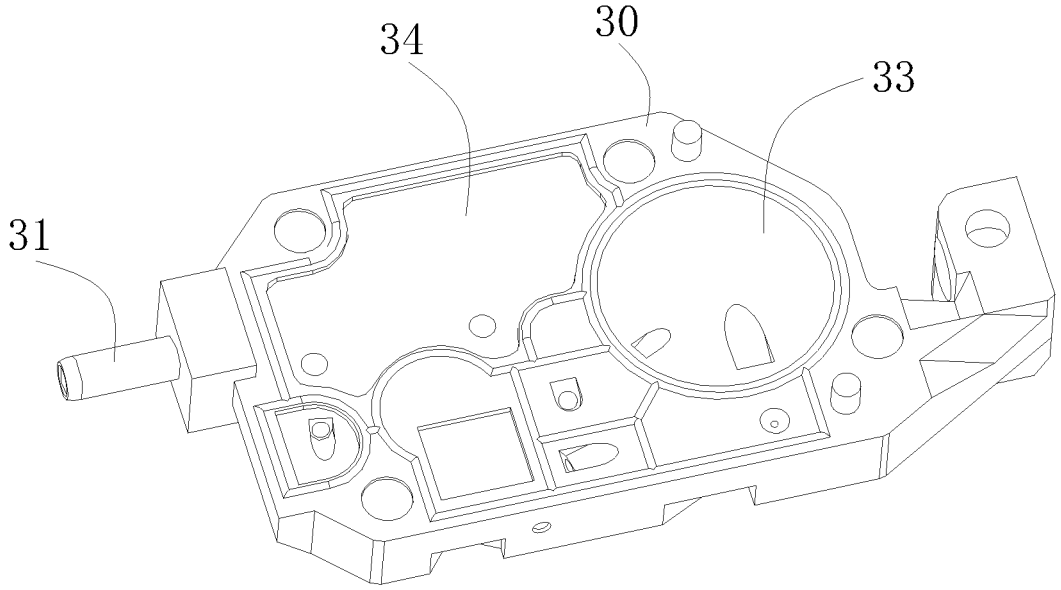
FIG. 13 is a perspective view of a cover portion of the fuel enrichment simple starting device in FIG. 2.
Figure 14:
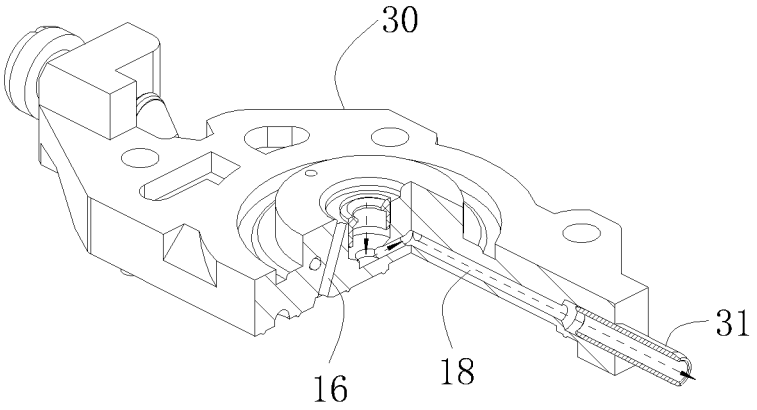
FIG. 14 is a cutaway view of part of the cover portion of the fuel enrichment simple starting device in FIG. 13.
Figure 15:
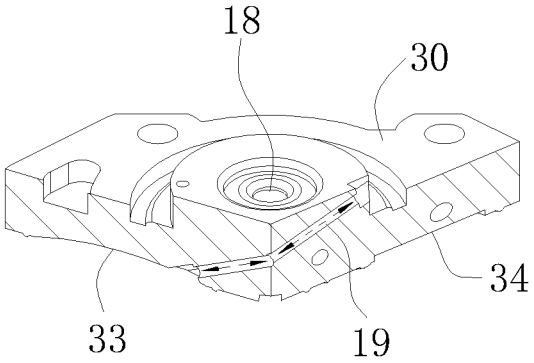
FIG. 15 is another cutaway view of another part of the cover portion of the fuel enrichment simple starting device in FIG. 13.

Referring to FIGS. 13 to 18, the cover portion includes a first cavity 33. The first cavity 33 is located on a side of the cover portion 30 away from the fuel cup 20 (as shown in FIG. 13). The base 40 includes a second cavity 41. The second cavity 41 is opposite to the first cavity 33. The first cavity 33 is in communication with the pump transferring passage 19. The second cavity 41 is in communication with the fuel inputting passage 15, the fuel passage 16, and the starting passage 17. The first cavity 33 and the second cavity 41 form the fuel chamber 14. The fuel pump diaphragm 11 is located between the first cavity 33 and the second cavity 41, the first cavity 33 forms the fuel pumping chamber 14*a*, and the second cavity 41 forms the fuel enrichment chamber 14*b*. The fuel pumping chamber 14*a* is not in communication with the fuel enrichment chamber 14*b*. The fuel cup 20, the pump transferring passage 19, the fuel pump diaphragm 11, and the fuel pumping chamber 14*a* will form the pump, which can remove the excess air and fuel and make fuel inject into the mixing room 12.

Referring to FIGS. 11, 13, and 16, the cover portion 30 includes a pulse fuel chamber 34. The base 40 includes a pulse pump chamber 42. The pulse fuel chamber 34 and the pulse pump chamber 42 are opposite and separated by the fuel pump diaphragm 11. The pulse fuel chamber 34 and the pulse pump chamber 42 are not in communication with each other. The pulse fuel chamber 34 is connected with a crank case of the engine 201. One end of the pulse pump chamber 42 is in communication with the metering room 13, and the other end of the pulse pump chamber 42 is in communication with the fuel tank 202. Before the engine 201 starts, an user presses the fuel cup 20, the fuel in the fuel tank 202 will flow into the pulse fuel chamber 34, and the fuel in the pulse pump chamber 42 will flow into the metering room 13. After the engine 201 starts, the crank case of the engine 201 will send a pulse to the pulse fuel chamber 34, resulting in the vibration of the fuel pump diaphragm 11, the fuel in the fuel tank 202 enters into the pulse pump chamber 42, then to the metering room 13, and finally to the mixing room 12.

The pump oil diaphragm 11 seals and isolates the first chamber 33 and the second chamber 41, respectively, so that the first chamber 33 forms the pump oil chamber 14*a*, and the second chamber 41 forms the oil-rich chamber 14*b*, which supplies for normal operation of the engine 201.

Referring to FIGS. 16 and 17, the base 40 includes a fuel input pipe 43. One end of the fuel input pipe 43 is in communication with the fuel tank 202, the other end of the fuel input pipe 43 is in communication with the pulse pump chamber 42, in order that the fuel in the fuel tank 202 can flow into the pulse pump chamber 42. The base 40 can further include a filter screen 44 located between the pulse pump chamber 42 and the metering room 13 and configured for filtering the fuel from the pulse pump chamber 42 to the metering room 13.

Figure 2:
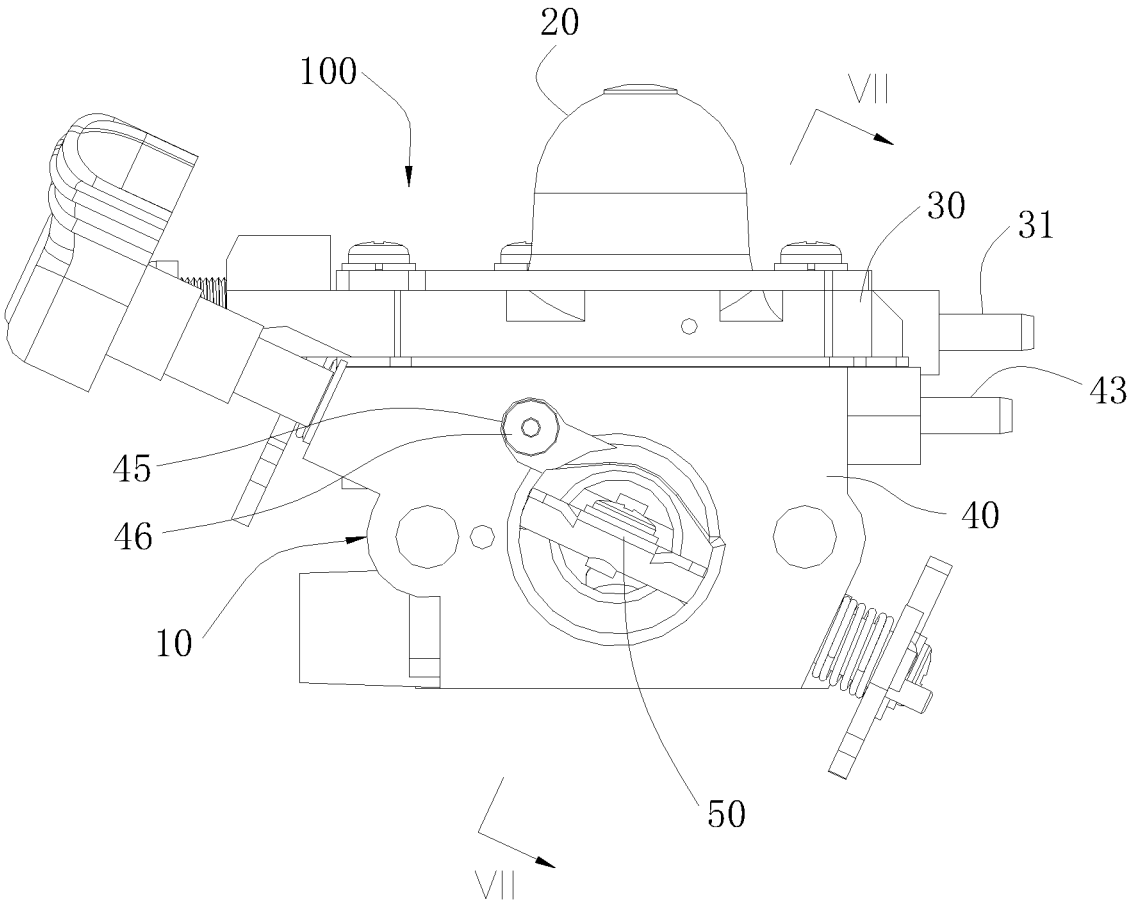
FIG. 2 is a perspective view of a fuel enrichment simple starting device for a carburetor of the present disclosure.
Figure 3:
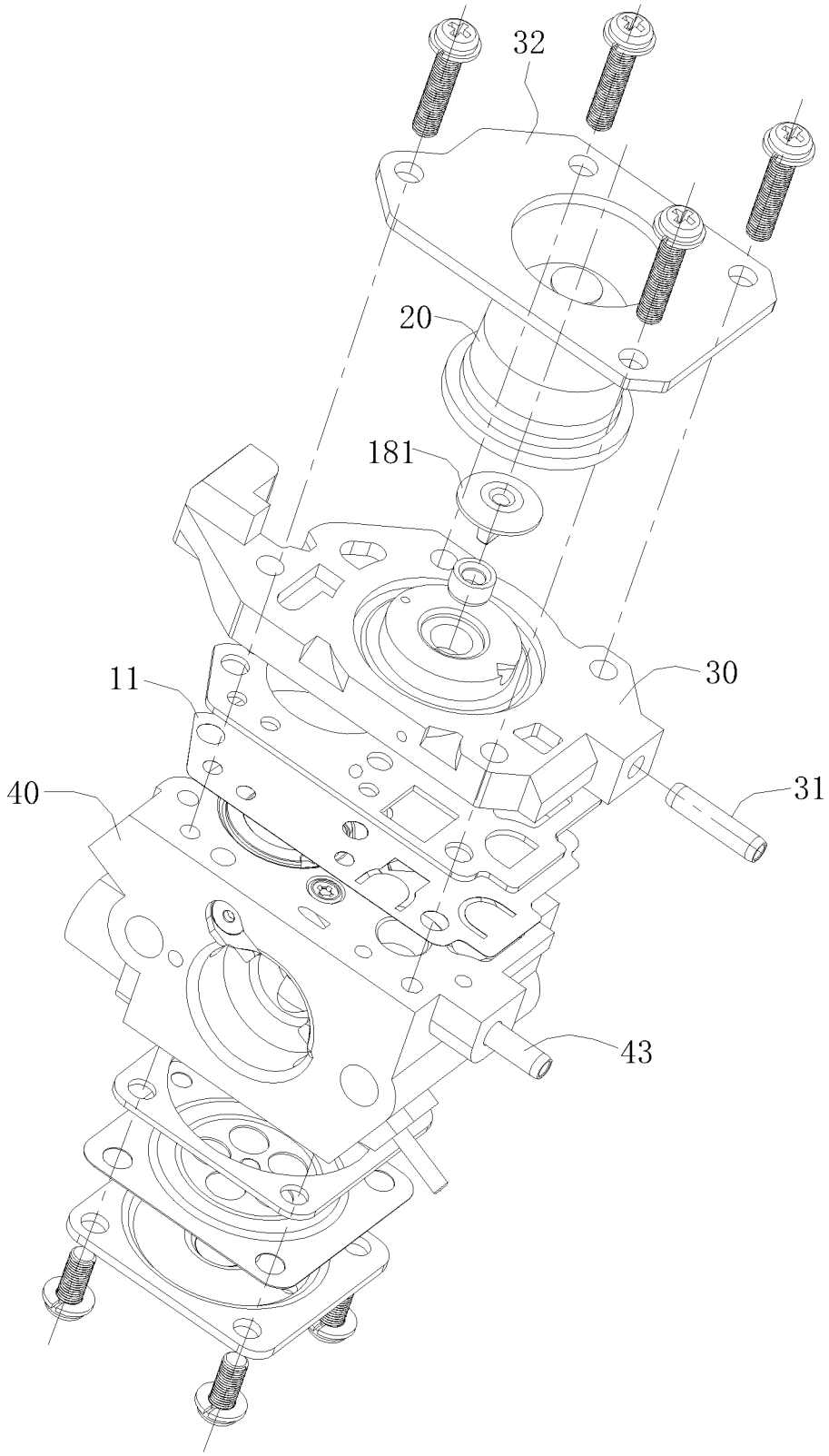
FIG. 3 is an exploded perspective view of the fuel enrichment simple starting device in FIG. 2.
Figure 4:
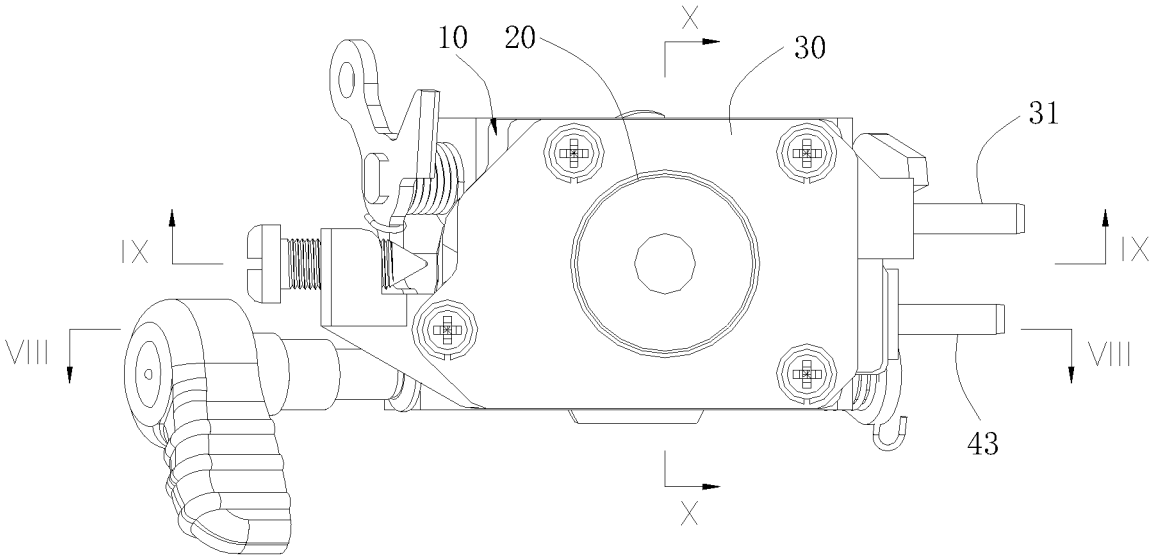
FIG. 4 is a top view of the fuel enrichment simple starting device in FIG. 2.
Figure 5:
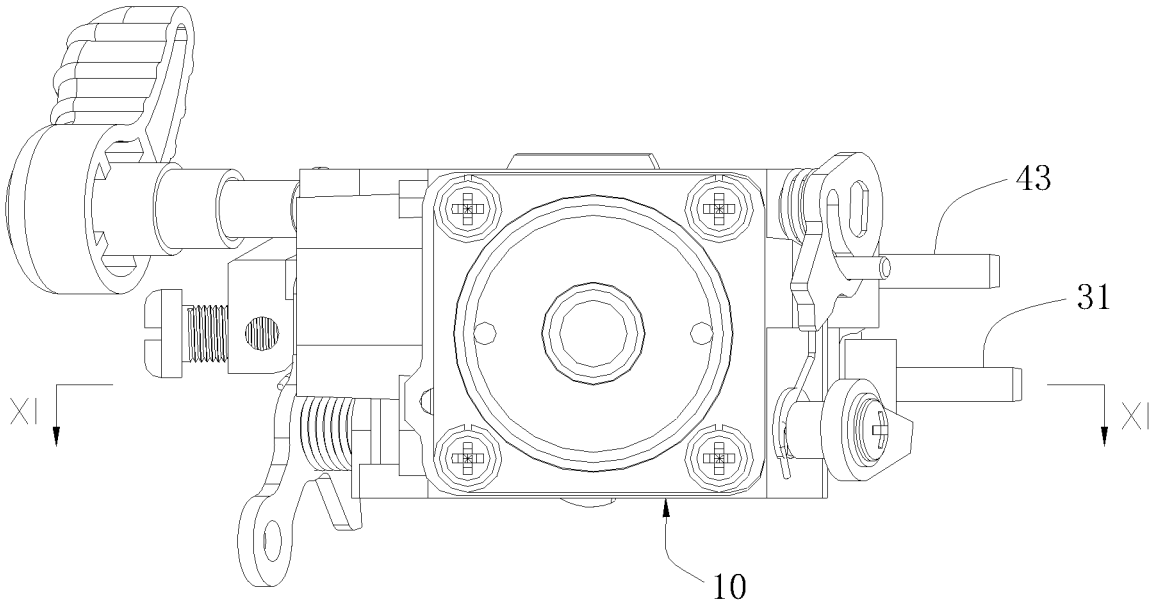
FIG. 5 is a bottom view of the fuel enrichment simple starting device in FIG. 2.
Figure 6:
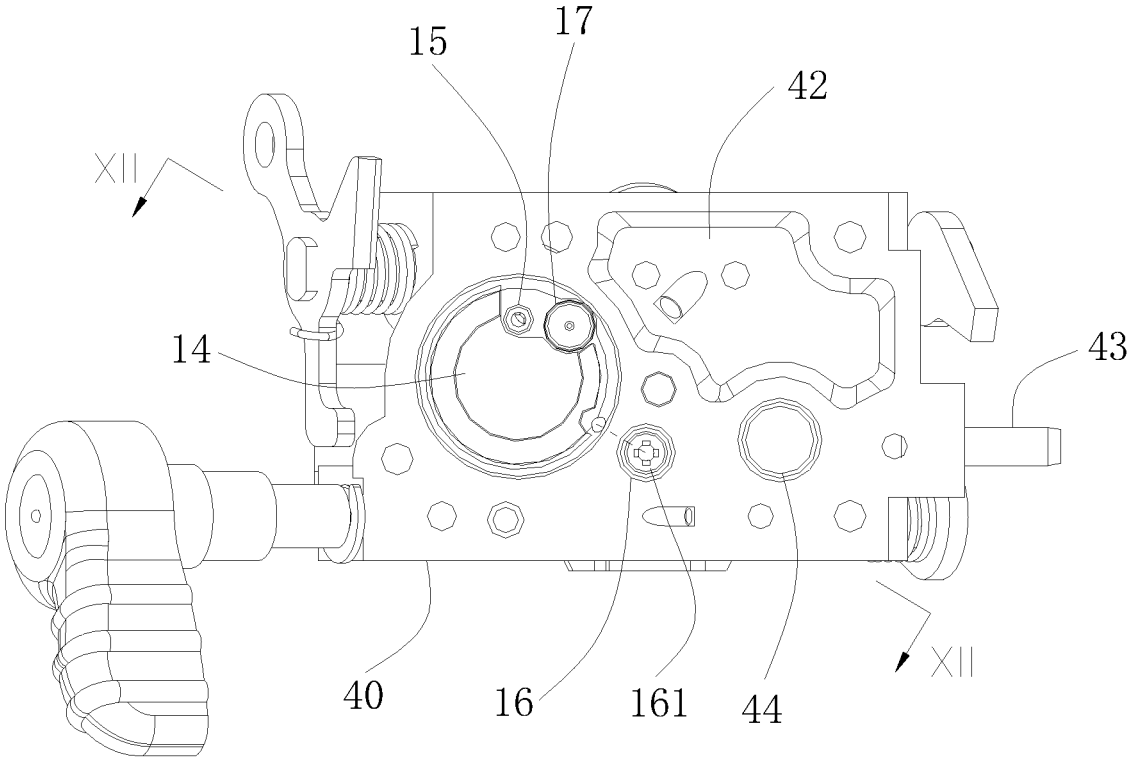
FIG. 6 is a top view of a main body of the fuel enrichment simple starting device in FIG. 2.
Figure 7:
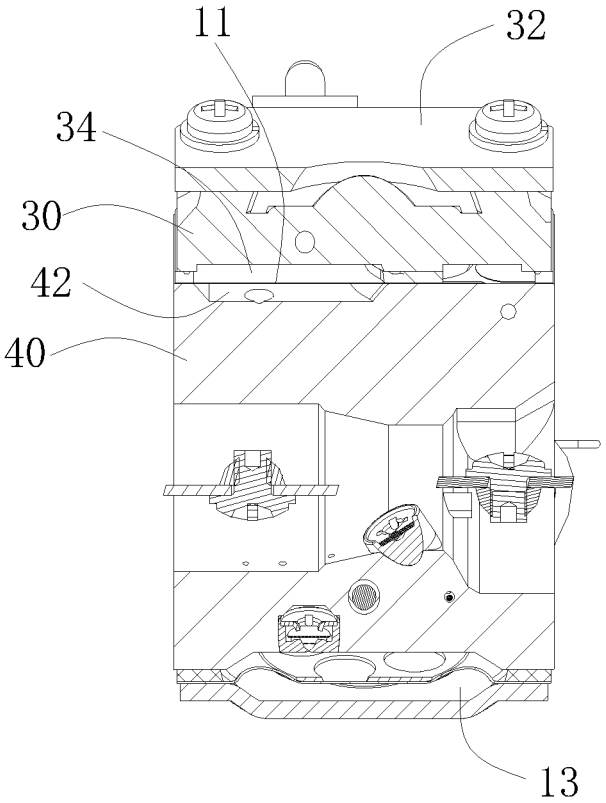
FIG. 7 is a cutaway view of the fuel enrichment simple starting device in FIG. 2 along line VII-VII.

Referring to FIG. 2, the main body 10 can further include a pressure balancing passage 45. One end of the pressure balancing passage 45 is in communication with the starting passage 17, and the other end of the pressure balancing passage 45 is in communication with the atmosphere. The pressure balancing passage 45 is configured for preventing the fuel in the fuel enrichment chamber 14*b* from being sucked out under the negative pressure generated by the engine 201 when the engine 201 operates normally.

Referring to FIG. 2, a retaining member 46 can be mounted in the pressure balancing passage 45 and configured for preventing the fuel in the starting passage 17 flowing out from the pressure balancing passage 45.

The retaining member 46 can be a check valve or other assembly having a non-return function.

Further, the pressure balancing passage 45 is located on the base 40, and the retaining member 46 is mounted at one end of the pressure balancing passage 45, which is in communication with the atmosphere.

Referring to FIG. 2, the main body 10 can further include a choke 50. The main boy 10 can include an air inlet in communication with the mixing room 12. The choke 50 is mounted on the air inlet and configured for controlling amount of the air entering into the mixing room 12.

In one embodiment, the choke 50 is a choke with high air flow. The choke 50 has a plate with small area, and air intake amount increases. The size of plate of the choke 50 depends on the size of the engine 201. The air intake amount will increase when the engine 201 is started. Compared with the prior art, the user does not need to manually open the choke to the one-half position to achieve the pre-heating of the engine 201.

The working principle of the fuel enrichment simple starting device 100 of carburetor is as follow.

Before the engine 201 starts, the fuel cup 20 is pressed and released repeatedly. When pressing the fuel cup 20, a positive pressure can be generated and transmitted to the fuel pumping chamber 14*a*. Under the positive pressure, the fuel pump diaphragm 11 can be driven to vibrate, resulting in part of fuel in the fuel enrichment chamber 14*b* injecting into the mixing room 12 through the starting passage 17 and the engine 201 starts. Part of the fuel in the fuel cup 20 can return to the fuel tank 202 through the fuel returning passage 18. When releasing the fuel cup 20, a negative pressure can be generated. Fuel in the fuel tank 202 can be sucked into the metering room 13. Fuel in the metering room 13 can be sucked into the fuel enrichment chamber 14*b* through the fuel inputting passage 15. And at the same time, part of the fuel in the fuel enrichment chamber 14*b* can be sucked into the fuel cup 20 through the fuel passage 16.

After the engine 201 starts, the fuel cup 20 is not pressed. The crank case of the engine 201 will send a pulse to the pulse fuel chamber 34, resulting in the fuel pump diaphragm 11 vibrates, the fuel in the fuel tank 202 enters into the pulse pump chamber 42, then to the metering room 13, and finally to the mixing room 12.

Figure 19:
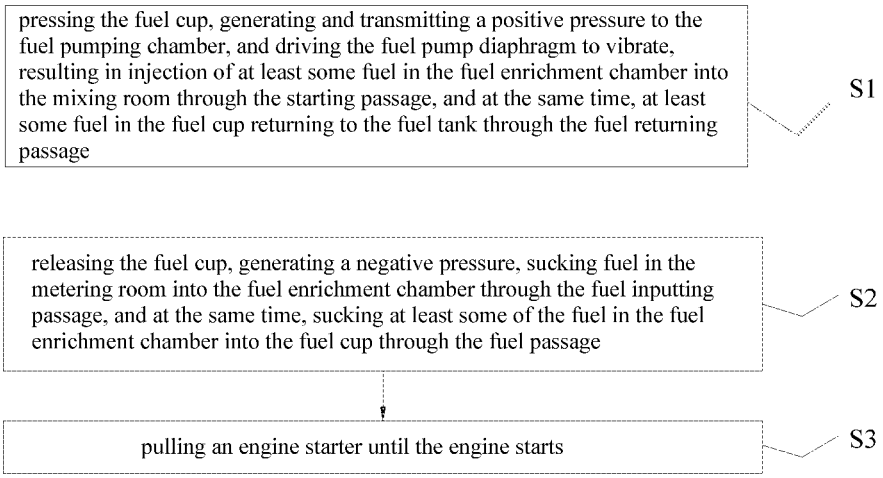
FIG. 19 is a flow chart of an engine starting method of the present disclosure.

Referring to FIG. 19, another embodiment of the present disclosure includes a starting method of an engine. The engine includes the fuel enrichment simple starting device 100 of carburetor. The starting method of the engine includes steps of:

S1, pressing the fuel cup 20, the positive pressure is generated and transmitted to the fuel pumping chamber 14*a*, and the fuel pump diaphragm 11 is driven to vibrate, resulting in part of fuel in the fuel enrichment chamber 14*b* injecting into the mixing room 12 through the starting passage 17, and at the same time, part of the fuel in the fuel cup 20 returns to the fuel tank 202 through the fuel returning passage 18;

S2, releasing the fuel cup 20, the negative pressure is generated, fuel in the metering room 13 is sucked into the fuel enrichment chamber 14*b* through the fuel inputting passage 15, and at the same time, part of the fuel in the fuel enrichment chamber 14*b* is sucked into the fuel cup 20 through the fuel passage 16; and S3, pulling an engine starter until the engine starts.

Furthermore, in step of S1, the first retaining valve 151 is closed and the second retaining valve 171 is opened. The fuel in the fuel enrichment chamber 14*b* can flow to the mixing room 12, but cannot return to the metering room 13.

In S2, the first retaining valve 151 is opened and the second retaining valve 171 is closed. The fuel in the metering room 13 can flow into the fuel enrichment chamber 14*b* through the fuel inputting passage 15. The fuel in the mixing room 12 cannot return to the fuel enrichment chamber 14*b* through the starting passage 17.

In a step S3, the engine starter can be pulled manually or by a power mechanism driving mode. In the present embodiment, the engine starter is manually pulled.

The starting method can further include a step of closing the choke after the step of pressing the fuel cup and before the step of pulling the engine starter.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A fuel enrichment simple starting device for a carburetor, comprising: a main body and a fuel cup disposed on the main body, wherein the main body comprises a mixing room, a metering room, a fuel chamber, a fuel pump diaphragm located in the fuel chamber and configured for separating the fuel chamber into a fuel pumping chamber and a fuel enrichment chamber, a fuel inputting passage, a fuel passage, a starting passage and a fuel returning passage;

wherein the fuel pumping chamber is in communication with the fuel cup, and the fuel enrichment chamber is in communication with the fuel cup through the fuel passage; one end of the fuel inputting passage is in communication with the fuel enrichment chamber, and the other end of the fuel inputting passage is in communication with the metering room; one end of the starting passage is in communication with the fuel enrichment chamber, and the other end of the starting passage is in communication with the mixing room; one end of the fuel returning passage is in communication with the fuel cup, and the other end of the fuel returning passage is in communication with a fuel tank.

2. The fuel enrichment simple starting device of claim 1, wherein a first retaining valve is located in the fuel inputting passage to prevent fuel in the fuel enrichment chamber from returning to the metering room.

3. The fuel enrichment simple starting device of claim 1, wherein a second retaining valve is located in the starting passage to prevent fuel and air in the mixing room from returning to the fuel enrichment chamber.

4. The fuel enrichment simple starting device of claim 1, wherein a duckbill valve is disposed in the fuel returning passage, the fuel passage and the fuel returning passage are separated by the duckbill valve, and fuel in the fuel cup returns to the fuel tank through the duckbill valve and the fuel returning passage.

5. The fuel enrichment simple starting device of claim 1, wherein the main body further comprises a pump transferring passage, one end of the pump transferring passage is in communication with the fuel cup, and the other end of the pump transferring passage is in communication with the fuel pumping chamber, a positive pressure generated by pressing the fuel cup is transmitted to the fuel pumping chamber through the pump transferring passage to drive the fuel pump diaphragm to vibrate.

6. The fuel enrichment simple starting device of claim 1, wherein the main body further comprises a pressure balancing passage, one end of the pressure balancing passage is in communication with the starting passage, and the other end of the pressure balancing passage is in communication with the atmosphere.

7. The fuel enrichment simple starting device of claim 1, wherein the main body further comprises a choke to control a ratio of air entering the mixing room.

8. A starting system, comprising an engine connected with the fuel enrichment simple starting device for a carburetor of claim 1.

9. A starting method for an engine connected with the fuel enrichment simple starting device for a carburetor of claim 1, comprising:

pressing the fuel cup, generating and transmitting a positive pressure to the fuel pumping chamber, and driving the fuel pump diaphragm to vibrate, resulting in injection of at least some fuel in the fuel enrichment chamber into the mixing room through the starting passage, and at the same time, at least some fuel in the fuel cup returning to the fuel tank through the fuel returning passage;

releasing the fuel cup, generating a negative pressure, sucking fuel in the metering room into the fuel enrichment chamber through the fuel inputting passage, and at the same time, sucking at least some of the fuel in the fuel enrichment chamber into the fuel cup through the fuel passage; and pulling an engine starter until the engine starts.

10. The starting method of claim 9, wherein a first retaining valve is disposed in the fuel inputting passage, a second retaining valve is disposed in the starting passage, in the pressing the fuel cup, the first retaining valve is closed and the second retaining valve is opened.

11. The starting method of the engine of claim 9, wherein in the releasing the fuel cup, the first retaining valve is opened and the second retaining valve is closed.

12. The starting method of the engine of claim 9, further comprising closing the choke after the pressing the fuel cup and before the pulling the engine starter.

* * * * *